United States Patent [19]

Tietz

[11] 4,213,316

[45] Jul. 22, 1980

[54] CYLINDER-LOCK MECHANISM AND KEY MEANS THEREFORE

[76] Inventor: Werner Tietz, Britzer Damm 196, 1000 Berlin 47, Fed. Rep. of Germany

[21] Appl. No.: 932,500

[22] Filed: Aug. 10, 1978

[51] Int. Cl.[2] ..... E05B 27/06

[52] U.S. Cl. ..... 70/35 B; 70/421

[58] Field of Search ..... 70/35 B, 364 A, 416, 70/419, 421

[56] References Cited

U.S. PATENT DOCUMENTS 3,742,744 7/1973 Lumme ..... 70/421

FOREIGN PATENT DOCUMENTS 73832 2/1952 Denmark ..... 70/421

2280772 2/1970 France ..... 70/421

*Primary Examiner*—Robert L. Wolfe

*Attorney, Agent, or Firm*—Hopgood, Calimafde, Kalil, Blaustein & Lieberman

[57] ABSTRACT

The invention contemplates a cylinder lock and associated flat-key configuration, the lock being virtually pick-proof and the key being virtually imitation-proof. These features arise from a particular employment of supplementary lateral ribs or cams on the key, of predetermined height and longitudinal location, coacting with a system of supplementary pins guided by transverse bores in the cylinder core, and one or more case pins of the conventional pin-tumbler components of the lock will dog the cylinder against key-operation beyond a limiting angle, should the supplementary rib or cam profile of the inserted key be incorrect.

11 Claims, 5 Drawing Figures

CYLINDER-LOCK MECHANISM AND KEY MEANS THEREFORE

The present invention relates to a closure device consisting of a rotary cylinder lock utilizing a flat key for operating the same.

The object of the invention is to produce an improved construction of the character indicated and having the feature that the key is virtually imitation-proof and the lock is virtually pick-proof.

More specifically, the invention pertains to a cylinder lock and flat key, wherein the flat key is characterized by one or more supplementary long ribs which extend laterally beyond the normal rib profile and are sensed by additional blocking pins arranged in the lock.

These additional blocking pins are supported by the cylinder core in bore holes each of which terminates in a recess of such size that, upon turning the cylinder core, one of the ordinary casing pins can enter into such a recess (and thus dog the core against further rotation) when one of the supplementary longitudinal ribs is not of the requisite predetermined height; thus the core will be dogged whenever the additional blocking pin which senses supplementary-rib height has not been sufficiently outwardly displaced to effectively fill the recess of its associated bore hole.

The closure device forming the basis of the invention will be explained in further detail in conjunction with the accompanying drawings in which.

Figures 1, 2, 3, 4, 5:
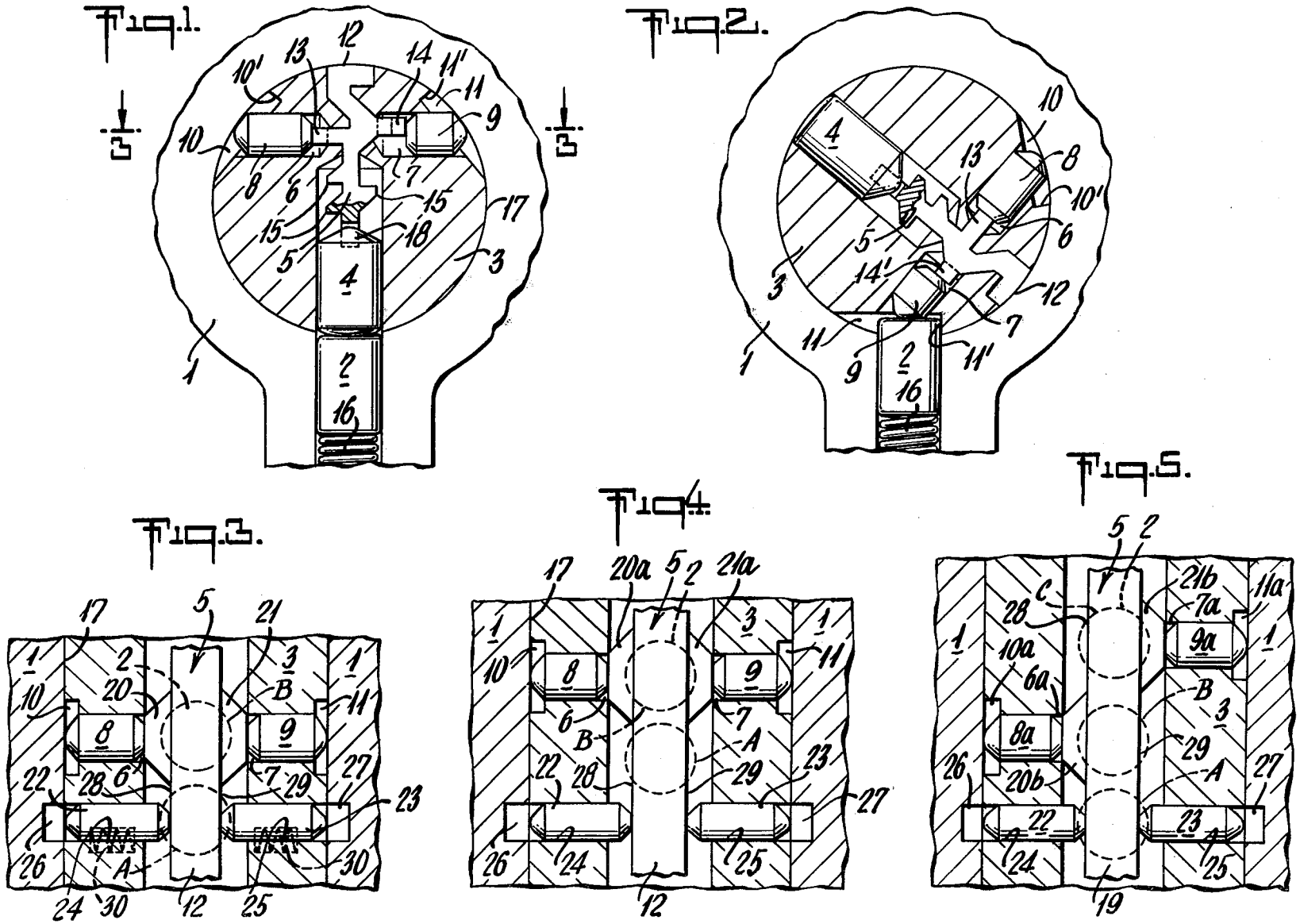
FIG. 1 is a fragmentary right-sectional view of one embodiment of a cylinder lock of the invention, the plane of the section being taken at the plane of one pair of the tumbler pins thereof, and the parts being shown for the key-inserted but non-rotated relation, the inserted key having the correct local profile at the plane of the section.
FIG. 2 is a view similar to FIG. 1, for a rotated or turned relation of parts, and illustrating a different key-pin relation, an incorrect key having been inserted.

FIGS. 3 and 4 are sectional views taken at the plane 3—3 of FIG. 1 to illustrate two different embodiments; and FIG. 5 is a view similar to FIGS. 3 and 4 to illustrate a further embodiment.

In FIGS. 1 and 2, a lock casing 1 contains a cylinder core 3 which can be turned by means of a corresponding flat key element 5 introduced via the customary key opening. A pair of tumbler pins are under the action of a compression spring 16 and consist of a casing pin 2 and a core pin 4; pins 2–4 are so positioned by the corresponding key-profile formation that their abutment elevation is flush with the outer surface 17 of the cylinder core 3, thus permitting the cylinder core to be turned. The tumbler pins 2–4 will be understood to be illustrative for one of a plurality of axially distributed tumblers along the axis of key insertion.

On its flat sides, key 5 has additional longitudinal ribs 13–14 which extend outwardly beyond the customary profile ribs 15 and are sensed by additional blocking pins 8–9 with respect to their predetermined height. The pins 8–9 are supported in lateral bore holes 6–7 in the core, and bore holes 6–7 terminate at local shouldered recesses 10–11 in the outer surface 17 of the core. The back of the key is identified at 12, and the pin-positioning profiles for the tumblers are provided at 18 on the opposite or narrow-edge side of the key.

At the predetermined height of the additional longitudinal ribs 13–14, the additional blocking pins 8–9 are pushed outward, such that they extend into the recesses 10–11 and thus are flush with the geometrical cylinder of surface 17. Upon rotation of the cylinder core 3, for example, about 120° in the clockwise direction, the casing pin 2 cannot enter the recess 11 and thus cannot block the cylinder core against further rotation. Rather, the recess 11, being occupied by the blocking pin 9, moves past the casing pin 2 without being occupied by the latter.

Things are different when either or both of the additional longitudinal ribs 13–14 is not of required height; this is the situation shown in FIG. 2. Specifically, in the situation of FIG. 2 the additional longitudinal rib 14' is too low, and therefore the additional blocking pin 9 has not been forced outward to the surface line 17. Since the recess 11 has thus not been occupied by the blocking pin 9, the casing pin 2 driven by spring 16 (FIG. 1) can, upon core rotation of about 120°, enter the recess 11, strike against the straight shoulder edge 11' thereof, and block the cylinder core against further turning.

One very important advantage of this closure device is that actuation of the lock is possible only with keys which have supplementary longitudinal ribs of the correct predetermined rib height at the sensing location or locations.

If these ribs are absent or if their height is not sufficient, blocking will occur upon approximately 120° of initial turning of the cylinder core, in either direction from the non-rotated or FIG. 1 relation.

The fact that these supplementary longitudinal ribs extend above the level of the ordinary profile ribs has already been stated. It should be added that the supplementary longitudinal ribs are independent of the key profile (18) and therefore their location along the length of the key can be various, from individual lock to individual lock and from one system to another, thus providing the advantage of an additional dimension of key variation.

The main advantage of the closure device, however, resides in the fact that keys bearing the additional longitudinal ribs are practically impossible to duplicate. This becomes clear if one bears in mind that the making of duplicate keys always involves removal of key-blank material, as by filing or milling, in order to develop the desired key profile or shape. Furthermore, since the unauthorized production of master keys from slave keys is also effected by removing the profiled ribs, the invention frustrates conventional methods of producing master keys, in that material is not to be removed, but rather added, in order to arrive at the key having the additional longitudinal ribs. It may be possible to add such material in individual cases in which the economy of the price is unimportant, but from a commercial viewpoint it is out of the question and therefore not feasible, due to the unavoidable high cost. In this connection, the basis for the impossibility of duplicating keys bearing the additional longitudinal ribs is that key blanks for them are obtainable only from the authorized manufacturer and that the key blanks for ordinary keys, including cross-bit keys, prove too weak to be able to produce keys with supplementary longitudinal ribs extending from them.

This great advantage of the virtual impossibility of duplicating the key still does not take into account protection against picking. Opening can, as has been shown, be effected by a key without the supplementary longitudinal ribs, upon sufficient simulation of the supplementary longitudinal ribs, as by laterally added pieces of wire of the required thickness. Such a procedure is, to be sure, not simple and requires skill and patience, but this fact by itself makes it necessary to consider how to eliminate this defect.

The pick-proof enhancing feature of the invention is based (a) on providing the flat sides of the key with at least one cam the height of which exceeds the height of the customary profiled ribs 15, and (b) on providing supplementary blocking pins, acting in combination, which are displaced in opposite directions in moving from the blocking position for the rotary cylinder 3 into the position of releasing the same. In this connection, additional blocking pins are provided which probe or sense the cams and which are moved outwardly in order to pass into their release position, said additional blocking pins being arranged in traversely extending cylinder-core bore holes and having the effective thickness of casing tumbler pins, or the bore holes terminating in shouldered recesses of corresponding width. Further in said connection, the supplementary blocking pins, as viewed from the key handle, have, arranged in front of them, additional supplementary blocking pins which sense the normal level of the flat sides of the key and are adapted to move inwardly into the release position; these additional pins are of lesser thickness than the pins which sense the cams and are supported in cylinder-core bore holes which can align with recesses, bore holes, grooves or the like in the lock case, said recesses, bore holes or grooves being located to receive entry of said additional supplementary blocking pins upon assuming their blocking position.

Thus, in accordance with the invention, two steps are provided by which it is possible to make the described lock, together with its copy-proof key, additionally secure against being picked. The first step is the replacement of the supplementary longitudinal rib(s) 13–14 by individual cams, and the second step is the introduction and very specific association of an additional pair of supplementary blocking pins which are arranged in front (as viewed longitudinally from the key handle) of the cam-sensing blocking pins and which sense the deeper portions of the flat side of the key. These supplementary blocking pins are movable outwardly into local shouldered recesses in the case, thereby establishing the blocking position.

The indicated pick-proof feature of the invention will be described in connection with the respective embodiments of FIGS. 3, 4 and 5. In these embodiments, it will be seen that any attempt to simulate the cam elevations by pieces of wire added laterally to a flat key must be unsuccessful since the further blocking pins arranged in front thereof do not permit the passage of such a tool or of any other tool. One therefore can no longer make sufficient key-insertion to reach the cam-following blocking pins located at the rear. In addition, any such manipulation has the effect of moving front blocking pins outwardly, to the extent of entry into the case (even though only partially) to block the lock.

In FIG. 3, as in FIGS. 1 and 2, the case 1 and its rotary cylinder 3 are recognized, as are two adjacent tumblerpin alignments A–B. The flat sides of key 5 (which will be understood to have a customary key profile 18, not shown in FIG. 3) are provided with cams 20–21 which are sensed for a predetermined height by the blocking pins 8 and 9. These blocking pins 8–9 lie in bore holes 6–7 at the radial plane of the tumbler-pin alignment B of the cylinder core, which bore holes terminate in recesses 11–12 of such width that the corresponding case pin 2 can enter into them, as long as they are not effectively filled by pins 8–9, after the initial turning of the cylinder core. The blocking action which is brought about by a thus-sensed insufficient height of the cams 20–21 corresponds completely to that of the lock described in connection with FIGS. 1 and 2. In front of cams 20–21, in the sense as viewed at the back 12 of the key in the front-to-rear aspect suggested by legend in FIG. 3, and at the general radial plane of the tumbler alignment A, there are provided portions 28–29 of the flat key sides which are of normal depth, or greater depth due to the bore holes, aganst which portions further blocking pins 22–23 in front of the blocking pins 8–9 perform their sensing function. Pins 22–23 are slidable in bore holes 24–25 in the cylinder core, which (in the locked or zero-angle positions) align with shouldered recesses, bore holes, grooves, or the like 26–27 into which the pins 22–23 enter when assuming their blocking positions. It should be pointed out that the blocking pins 8–9 are in the blocking position when they have moved inward since they then give the casing pin 2 an opportunity to enter into one of the recesses 10–11, and that the other blocking pins 22–23 are in the blocking position when they move outwardly and have entered into the case bore holes 26–27. This opposed direction of motion of the pairs of blocking pins 8–9 on the one hand, and 22–23 on the other hand, which is required for the operation of the lock, is present also with respect to the release positions; the pins 8–9 release when they, filling the recesses, have moved to the outside, and the pins 22–23 are in release condition when they, leaving the bore holes 26–27, have been displaced for full containment by and within the cylinder 3.

Although the pick-proof function has already been indicated, it will again be explained in the context of the embodiment of FIG. 3. Let it be assumed that an unauthorized attempt is made to inactivate the blocking pins 8–9, by means of tools (or of a key) in which the same elevations are simulated by attached wires or the like, it being the intent that the said blocking pins 8–9 be thereby driven outwardly upon key insertion. However, in order for the inserted key or tool to gain actuating access to the blocking pins 8–9, one must overcome the blocking pins 22–23 which are disposed in front of them; but in making such as insertion, pins 22–23 are pushed to the outside and enter the bore holes or the like 26–27, whereby the cylinder core 3 is immediately blocked against turning. Thus, unauthorized opening of the lock has become impossible, since any handling thereof results in blocking.

Upon the introduction of the key, a temporary blocking of the lock takes place upon passage of the cams 21–22 past the blocking pins 22–23, since the blocking pins 22–23 follow the cam profiles and are outwardly displaced, to enter the correspondingly deep bore holes 26–27 which they then can leave again after transient passage of cams 20–21 and therefore prior to or upon complete insertion of the key, it being understood that resilient means suggested at 30, normally urge pins 22–23 from their outer positions to their release positions, shown in FIG. 3.

For assurance against duplication of a key having cam elevations 20–21, the same applies as has been stated with respect to the assurance against duplication of a key bearing the supplementary longitudinal ribs 13–14. Both are duplication-proof to the same extent, since the cams extend beyond the ordinary-rib profile (15) and therefore cannot be produced out of ordinary key blanks.

The position of the cams can be varied with respect to distance from the back edge 12 of the key, as well as in axial direction from key to key, and from master-key system to master-key system. One example of this can be noted from FIG. 4, where the blocking pins 8–9 to be actuated by the cams 20*a*, 21*a*, are located at a different offset from the supplementary blocking pins 22–23, as compared with the arrangement of pins 8–9 for the cams 20–21 in FIG. 3. A plurality of cams separated by valleys can also be provided, one behind the other, as well as cams of unequal number and/or grouping provided on the respective right and left sides of key 5, as viewed in FIGS. 3 and 4.

FIG. 5 illustrates further possibility for increasing the variety of key-lock combinations. According to the embodiment of FIG. 5, the blocking-pin bores 6*a*–7*a* (and the blocking pins 8*a*–9*a*) are axially offset from each other, at radial planes of different tumbler-pin alignments B–C, requiring side-profile cam projections 20*b*–21*b* at correspondingly offset locations on the flat sides of key 5. The lock manufacturer is thus provided with a further-widened field of possible variation of key-lock combinations, particularly for master-key systems.

It will be seen that the described embodiments of the invention meet the stated object and enable the lock manufacturer to substantially increase the number and variety of unique locking combinations. While a large number of variations is obtainable via the coordination notches and profiled ribs of a customary flat key, nevertheless it is desirable and the invention provides availability of lock combinations which not only substantially exceed known combinations but also provide inherent pick-proof features. And the axial-offsetting possibilities for selection of different pin-tumbler alignment planes for blocking pins 8*a*–9*a* (and associated local cam projections distributed along the length of the side-profile rib or ribs of a flat key) expand with the number of pin-tumbler sets embodied by a given cylinder lock.

What is claimed is:

1. A cylinder lock, comprising a casing having a primary bore, a cylinder rotatable in the bore and having a longitudinally extending insertion slot for reception and longitudinal guidance of an inserted substantially flat key, coacting pin-tumbler means carried by said casing and cylinder and establishing a predetermined rotationally locked angular relation of said cylinder and casing in the absence of insertion of a key having a correct pin-tumbler actuating profile, said pin-tumbler means comprising a longitudinally distributed plurality of case pins and core pins and pin-guide bores in said casing and cylinder and aligned with each other when in said locked angular relation, spring means carried by said casing and normally urging said core pins via their associated said case pins to a radially inner position in which said case pins simultaneously engage both of the associated aligned pin bores to thereby retain the locked angular relation in the absence of such key insertion as will elevate the locus of all pin-to-pin abutments to a rotary-release position at the effective radius of said cylinder, said cylinder having a transversely extending blocking-pin bore substantially normal to the general plane of the path of the flat of the key-insertion passage via the slotted opening, said blocking-pin bore having at its outer end an enlarged generally radially shouldered recess of size and radial-plane alignment as to accommodate limited radially inward entry of one of said case pins in the event that said recess is unoccupied upon cylinder rotation to the extent of aligning the pin-guide bore of the casing with said recess, a blocking pin in said blocking-pin bore and therefore on one side of the path of key insertion, the effective length of said blocking pin being less than the effective length of blocking-pin bore in which it is guided, whereby upon insertion of a key having a side-rib projecting profile to engage and sufficiently elevate said blocking pins to substantially the geometrical cylindrical surface of said cylinder, and upon thereafter rotating said cylinder, said core pin will be prevented from entering the applicable one of said recesses, and further whereby upon insertion of a key having effectively less than said side-rib projecting profile, said core pin will be resiliently urged to dog said cylinder against continued rotation in said casing.

2. The cylinder lock of claim 1, in which at a location forwardly offset from said blocking-pin bore said cylinder has a supplementary blocking-pin bore generally normal to a flat side of the path of key insertion and open through the outer surface of said cylinder, a supplementary blocking pin in said blocking-pin bore and means normally urging the same to an inner position of key-side engagement with the outer end of said supplementary blocking pin contained within the effective geometrical cylindrical outer surface of said cylinder, and the bore of said casing having a local shouldered recess for reception of said supplementary blocking pin when said casing and cylinder are in said locked angular relation, said last-mentioned recess being of such depth as to fully accommodate said supplementary blocking pin when outwardly driven by passage of a key having said side-rib profile; whereby said cylinder may be key-operated only upon full insertion of a key having said side-rib profile at the axial location of said one case pin, and only if said side-rib profile has terminated at the axial location of said last-mentioned recess to release said supplementary blocking pin from its casing recess.

3. The cylinder lock of claim 2, in which said supplementary blocking pin and supplementary blocking-pin bore and casing recess are one of two like oppositely directed sets of cooperating parts, on opposite flat sides of the path of key insertion.

4. The combination of a cylinder lock according to claim 1, and a generally flat key adapted for guided insertion in the slotted opening of said cylinder, said key having a profiled edge to engage and elevate said pin-tumbler means to rotation-release position when fully inserted, and said key having a laterally profiled rib of sufficient effective rise to elevate said blocking pin to substantially the geometrical cylindrical surface of said cylinder when fully inserted.

5. The combination of a cylinder lock according to claim 2, and a generally flat key adapted for guided insertion in the slotted opening of said cylinder, said key having a profiled edge to engage and elevate said pin-tumbler means to rotation-release position when fully inserted, and said key having a laterally profiled rib of sufficient effective rise to elevate said blocking pins to substantially the geometrical cylindrical surface of said cylinder when fully inserted, said profiled rib being cam-sloped on both longitudinal sides of said rise.

6. The combination of claim 4, in which at least one of the flat coacting sides of said key and slotted opening have straight longitudinal rib and rib-receiving formations of effective height less than the rise of said laterally profiled rib, whereby duplication of said key requires adding material beyond that available in a conventional key blank.

7. The cylinder lock of claim 1, in which said blocking-pin bore is one of a plurality of such bores at different longitudinally spaced pin-bore alignments, whereby key-operation of the lock is possible only for insertion of a key having the correct side-rib projecting profile at the correctly associated spaced pin-bore alignments.

8. The cylinder lock of claim 1, in which said blocking-pin bore is one of two such bores at said one pin-bore alignment and on opposite sides of the general plane of the flat of key-insertion.

9. The cylinder lock of claim 7, in which said one blocking-pin bore and another blocking-pin bore of said plurality are on opposite sides of the general plane of the flat of key-insertion.

10. The cylinder lock of claim 2, in which said supplementary blocking-pin bore is axially offset from the general radial plane of any of said case pins.

11. The cylinder lock of claim 2, in which said supplementary blocking-in bore is at the general radial plane of another one of said case pins.

* * * * *